US006620243B1

(12) United States Patent
Bertellotti et al.

(10) Patent No.: US 6,620,243 B1
(45) Date of Patent: Sep. 16, 2003

(54) FLUIDIZED BED POWDER HANDLING AND COATING APPARATUS AND METHODS

(75) Inventors: Christopher P. Bertellotti, New Britain, CT (US); Colin Drummond, Lakewood, OH (US); Mark Heckler, Meriden, CT (US); Joseph Rogari, Trumbull, CT (US); Don Urig, Elyria, OH (US)

(73) Assignee: Nordson Corporation, Westlake, OH (US)

( * ) Notice: Subject to any disclaimer, the term of this patent is extended or adjusted under 35 U.S.C. 154(b) by 633 days.

(21) Appl. No.: 09/087,521

(22) Filed: May 29, 1998

(51) Int. Cl.[7] ..... B05C 5/02
(52) U.S. Cl. ..... 118/621; 118/DIG. 5; 427/459
(58) Field of Search ..... 427/459; 118/DIG. 5, 118/621

(56) References Cited

U.S. PATENT DOCUMENTS 2,986,475 A * 5/1961 Mesnard et al. ..... 117/100
3,599,603 A * 8/1971 Koch, II ..... 118/629
3,865,701 A * 2/1975 Borgmann ..... 204/28
3,871,328 A * 3/1975 English ..... 118/629
4,122,798 A * 10/1978 Gibson ..... 118/50
4,170,074 A * 10/1979 Heckman et al. ..... 34/57 A
4,377,364 A * 3/1983 Weaver ..... 414/307
4,606,928 A 8/1986 Dunford et al. ..... 427/32
4,710,286 A 12/1987 Mulder ..... 209/250

* cited by examiner

*Primary Examiner*—Shrive P. Beck
*Assistant Examiner*—Michael Cleveland
(74) *Attorney, Agent, or Firm*—Wood, Herron & Evans, L.L.P.

(57) ABSTRACT

An electrostatic fluidized bed powder coating apparatus including powder coating structure, such as a coating enclosure, hood or booth, and a powder fluidizing bed operatively associated with an electrostatic charging device. An enclosed powder accumulator is provided for collecting excess powder from the powder coating structure. A vacuum pump communicates between the powder coating structure and the powder accumulator and is operable by a source of compressed air for forming and controlling a cloud of powder emanating from the fluidizing bed and for transferring excess powder from the powder coating structure to the powder accumulator. In the preferred embodiment, the accumulator includes a cyclone housing. A powder reclaim feeder is disposed below and in communication with the cyclone housing and further communicates with a new powder feeder. A powder conveyor, in the preferred form of a rotating auger, transfers powder from the new powder feeder into the powder reclaim feeder and ultimately transfers the mixed powder into the powder coating structure.

28 Claims, 5 Drawing Sheets

FLUIDIZED BED POWDER HANDLING AND COATING APPARATUS AND METHODS

FIELD OF THE INVENTION

The present invention generally relates to powder handling systems and methods and, more specifically, to electrostatic fluidized bed powder coating systems and methods.

BACKGROUND OF THE INVENTION

Powder must be handled and transferred in a wide variety of systems. For example, powder coating technology has generally evolved over several years into several different coating techniques performed with various types of coating systems. With each technique and apparatus, a powder, such as a resinous polymer or paint, is initially adhered to an electrically conductive object or substrate. This initial coating typically involves electrically grounding the object or substrate and electrostatically charging the powder particles such that the electrostatic attraction causes the powder to adhere to the part or substrate in a uniform thickness. This initial powder coating is then cured using heat or other techniques, such as infrared or ultraviolet light, to fully adhere the coating to the part or substrate.

Conventional techniques for adhering the powder particles to an object before curing have included three general types. Two of these coating techniques involve the use of fluidized powder beds. In the first of these techniques, the part is heated and then dipped into a fluidized bed of powder particles. The particles partially coalesce or tackify and thereby stick to the part. The second technique involves electrostatically charging the powder particles such that they emanate in a cloud from a fluidized powder bed. When an electrically conductive, grounded part is placed with this emanating cloud of electrostatically charged powder particles, the charged particles will be attracted to the outer surfaces of the part. The grounded part may be manually placed within a powder coating structure containing the electrostatically charged powder cloud or may be on a conveyor system or automatic feed system which moves parts or the substrate continuously into and out of the coating structure. A third general technique for powder coating also involves electrostatic charging of powder particles, however, this technique utilizes a spray gun. An electrostatic spray gun generally emits powder particles while electrostatically charging those particles by utilizing a charged electrode at the gun nozzle. Guns also exist which emit a stream of powder particles that are charged by a process commonly referred to as tribo charging. In spray coating techniques, the parts to be coated are again electrically grounded and are typically contained within a coating structure or hood having a vacuum system which collects excess sprayed powder. The three general techniques described above may also have many variations.

Each of the above described powder coating techniques has different advantages and limitations. Powder handling in general is also a problematic area in that it often involves a variety of powder filtering, transfer and containment challenges. Powder coating and process equipment generally is connected to powder collection equipment for collecting airborne powder which has not adhered to the part or substrate during the initial coating process. This equipment may also be referred to as powder reclaim equipment and has been free standing structure relative to the powder processing or coating equipment. This results in increased use of floor space and higher associated costs. For example, in a typical electrostatic fluidized bed coating system, excess powder is reclaimed from powder coating enclosure or structure with vacuum applied by a collector including a blower. Within the collector, and upstream of the blower, the powder is the trapped within one or more filters while air exits the collector. Periodically, the filters are internally pulsed with positively pressurized air to disengage the powder from the filter. The powder then may drop into a reclaim hopper located below the powder collector. The reclaimed powder is then transferred manually or by a conveyorized system to the powder processing equipment, such as the powder coating structure or enclosure.

Powder coating equipment, such as described above, also has drawbacks in terms of the ability to adjust the vacuum being applied to the powder coating structure or enclosure. The blower used in the powder collector portion of the system draws a specific amount of air usually designated in cubic feet per minute. One or more conduits may be connected between the blower and the powder coating structure or enclosure and, for adjustment purposes, slide gates have been connected within these conduits to selectively block the air and powder flow. In this way, air and powder being drawn out of the powder coating structure or enclosure may be increased or decreased depending on the position of the slide gate. While some operators have been known to mark the slide gate position at a desired location, this has not been a generally acceptable or precise manner of adjustment. Moreover, the use of a blower assembly in combination with a pulsable filter within a collector is rather cumbersome. In addition, as the filter or filters become clogged with powder, there can be an undesirable change in the level of collection vacuum applied to the powder coating structure or enclosure. This can adversely affect the powder coating process.

To address problems such as these in this general area of powder handling and coating technology, it would be desirable to provide a powder handling and/or processing or coating system which may be automated, compact and more portable, and more easily and precisely adjustable in accordance with the specific application needs.

SUMMARY OF THE INVENTION

The present invention provides powder handling and coating apparatus and methods achieving advantages to address the problems mentioned above as well as other powder coating and handling problems. For example, the invention can provide an automated powder coating system which is relatively compact as compared to prior systems. Powder may be conveniently added to supply a closed loop powder handling system of the invention. The system can also automatically mix reclaimed powder and new or so-called virgin powder prior to conveying the mixture into coating structure associated with the system. Also the system eliminates the need for the primary powder filters typically contained in the powder collection loop and therefore eliminates the change in collection vacuum associated with such filters. Also, powder color and/or powder type may be more easily changed due to the elimination of filters in the powder collection loop and the more compact system configuration.

In fulfillment of these and other advantages, and in accordance with one aspect of the invention, an electrostatic fluidized bed powder coating apparatus is provided which may include typical powder coating structure, powder fluidizing bed structure and an electrostatic charging device disposed to charge the powder such that it emanates from the fluidizing bed. The powder coating structure may be an enclosure which substantially fully encloses a product, part or substrate during a coating operation or may be a structure which has one or more openings to allow automated or manual introduction of such products, parts or substrates. In accordance with this aspect of the invention an enclosed powder accumulator collects excess powder from the powder coating structure during the powder coating operation. In accordance with the invention, a vacuum pump communicates between the powder coating structure and the powder accumulator and is operated by a source of compressed air capable of precise regulation. Due to the use of a vacuum pump in this way, primary powder filters and associated pulse valves are not necessary. This eliminates the significant drawbacks of blower and filter systems as generally used with fluidized bed systems in the past. The vacuum pump precisely controls the negative pressure in the powder coating structure to ensure full, uniform coating. The vacuum pump can also immediately transfer excess powder from the powder coating structure to the powder accumulator without the need for repeated filter pulsing operations.

A pressure regulator may be advantageously connected to the vacuum pump and, more specifically, to the compressed air being introduced into the vacuum pump. As mentioned above, this pressure regulation precisely controls the collection vacuum being applied to the coating structure. In one desirable embodiment, a plurality of vacuum pumps may be connected with a plurality of conduits leading from different locations of the powder coating structure to the powder accumulator. For example, a powder coating area may be a central area within the powder coating structure and the powder coating structure may further include a pair of powder drag out areas. These powder drag out areas are preferably connected with at least one additional source of vacuum, such as additional vacuum pumps as described above, to transfer powder from the drag out areas to the powder accumulator.

As a further advantage of this invention, the accumulator is preferably a cyclone housing including an air and powder inlet through which air and excess powder are received from the vacuum pump associated with the coating structure. A powder reclaim chamber or, more specifically, feeder is located below the air and powder inlet of the cyclone housing and an air vent is disposed above the air and powder inlet. Thus, air entering through the inlet exits the cyclone housing through the air vent while excess powder loses energy due to the cyclonic flow pattern and drops into the powder reclaim feeder.

Also in accordance with the invention, a powder conveyor is connected between the powder reclaim feeder and the powder coating area for transferring the excess or reclaimed powder back into the powder coating area. Even more desirable is a construction in which a new powder feeder is mounted adjacent to the powder reclaim feeder and a conveyor, preferably in the form of a motorized, rotatable auger, extends from the new powder feeder through the powder reclaim feeder, and into the powder coating area. Finally, the reclaimed powder is preferably transferred into the powder coating area at a rate faster than new or so-called virgin powder is transferred into the powder reclaim feeder. This helps prevent powder in the reclaim feeder from reaching a level that interferes with the operation of the cyclone housing. These many features and additional features of the inventive apparatus may be combined in various manners to achieve one or more advantages of the invention.

The invention further contemplates methods of forming and controlling a cloud of powder, such as during a powder coating process. Such methods can include electrostatically charging and fluidizing a bed of powder to initiate the formation of a cloud of powder, applying negative pressure to the cloud of powder using a powder transfer device operable by a source of compressed air, and regulating the compressed air to control the negative pressure. As generally discussed with respect to the apparatus described above, these methods can also include transferring excess or reclaimed powder through a cyclone housing and into a powder reclaim feeder, introducing new powder into the powder reclaim feeder to produce a mixture of new and excess powder, and transferring the mixture of new and excess powder into the powder coating area. In general, the methods can include various steps performed in accordance with the operation of systems embodying the inventive concepts.

Additional advantages and objectives of the invention will become more readily apparent to those of ordinary skill in the art upon review of a detailed description of one preferred embodiment of the invention, taken in conjunction with the accompanying drawings.

DETAILED DESCRIPTION OF THE PREFERRED EMBODIMENT

Figure 1:
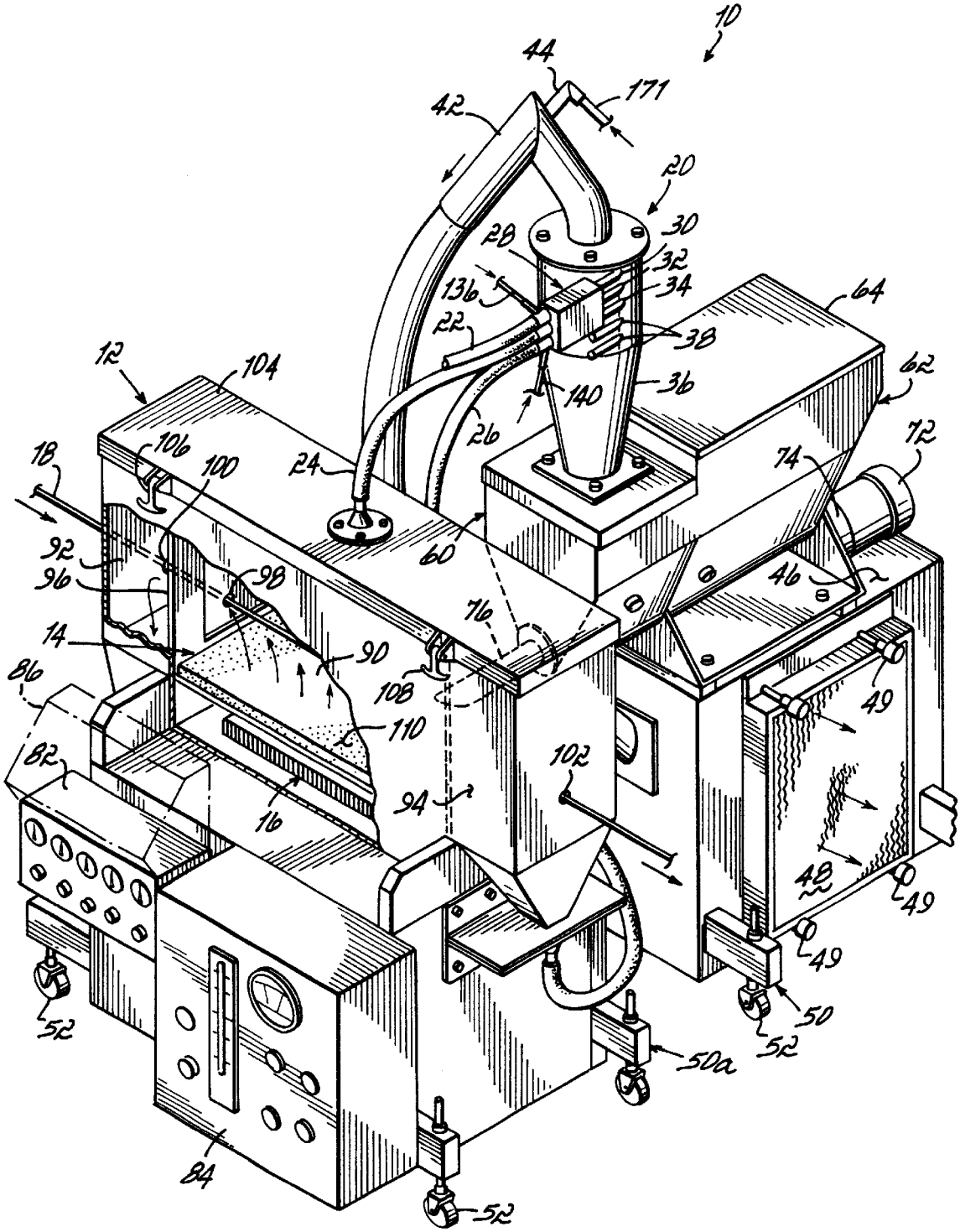
FIG. 1 is a perspective view of an electrostatic fluidized bed powder coating apparatus constructed in accordance with one embodiment of the invention.
Figure 2:
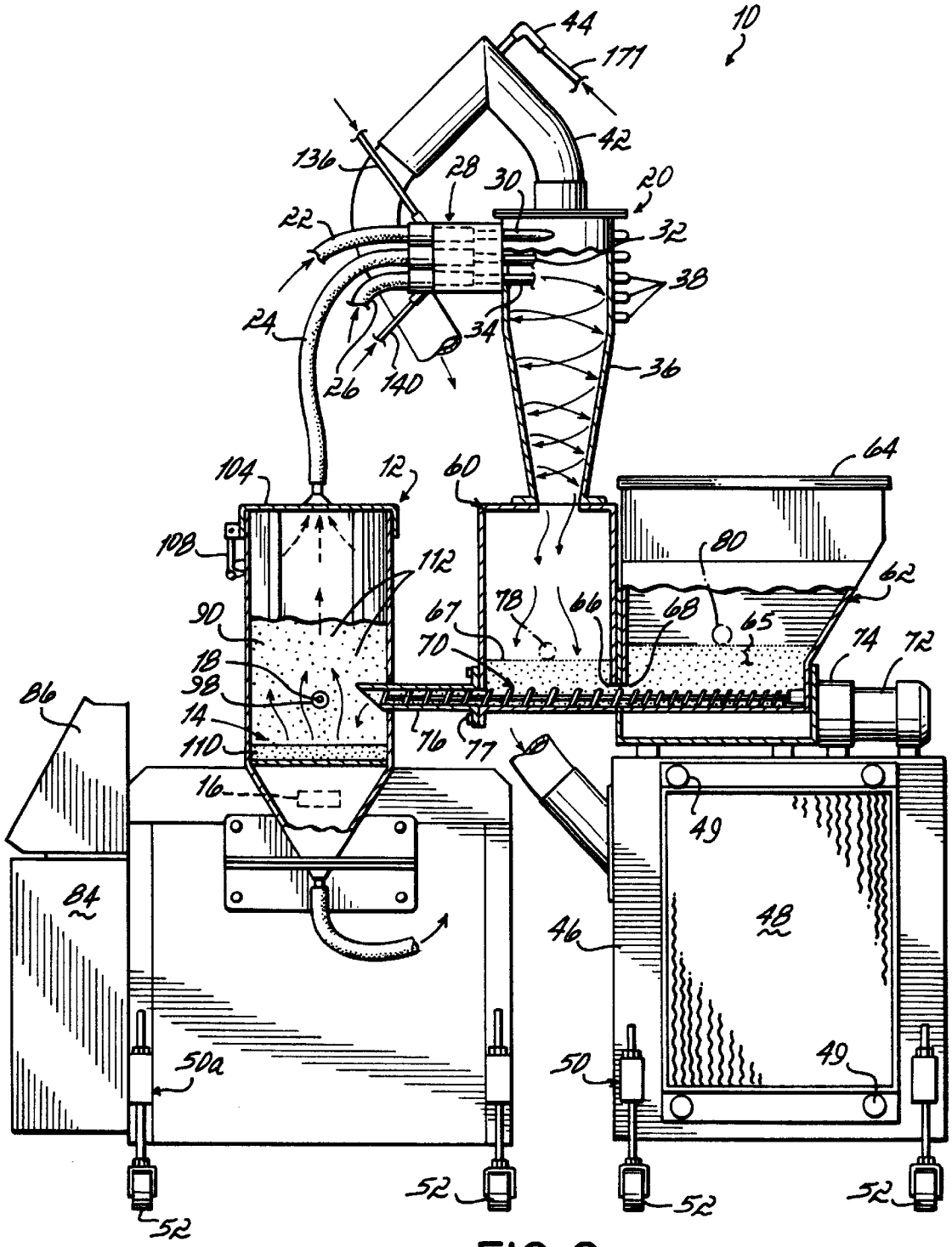
FIG. 2 is a side elevational view of the apparatus shown in FIG. 1, and partially fragmented to show certain internal components and operation.

Referring generally to FIGS. 1 and 2, an electrostatic fluidized bed coating apparatus 10 is shown constructed in accordance with one preferred embodiment of the invention. It will be appreciated that the invention may take on many other forms as well. Apparatus 10 specifically includes powder coating structure 12 operatively connected with both a fluidized bed 14 and an electrostatic charging unit 16. In this embodiment of the invention, powder coating structure 12 is almost fully enclosed and adapted to coat a wire 18 in a continuous manner. Other substrates, including discrete parts and products, may be coated instead. Fluidized bed 14 preferably includes a porous plate through which pressurized air is directed and electrostatic charging unit 16 is preferably an electrode including many wire bristles. Fluidized bed 14 and electrostatic charging unit 16 may be constructed generally as disclosed in U.S. Pat. No. 94,606, 928, assigned to the assignee of this invention and the disclosure of which is hereby incorporated by reference. As discussed in U.S. Pat. No. 4,606,928, but not shown in the present drawings, such electrostatic coaters may also utilize a vortex generating device for uniformly coating substrates, such as wires and the like. Many different types of electrostatic coating structures may be used in place of structure 12 shown in FIGS. 1 and 2. These, for example, may include structures having one or more larger openings for allowing larger parts or objects to be inserted into the coater and coated electrostatically, or may include hood structures having completely open side portions. It will be understood that the electrostatic charging unit 16 may also take on many forms depending on the application needs and preferences of the operator.

As further shown in FIGS. 1 and 2, a powder accumulator 20 receives powder via conduits 22, 24, 26 communicating with the inside of powder coating structure 12. A vacuum source or powder transfer device 28, to be described below with respect to one advantageous form, draws air and powder from the inside of powder coating structure 12. Ports 30, 32, 34 lead from vacuum source 28 to a cyclone housing 36 of accumulator 20. These ports 30, 32, 34 communicate in a tangential fashion with the inside of cyclone housing 36 to induce a cyclonic flow pattern. A number of spare ports 38 may be included on cyclone housing 36 for use in different applications. When not in use, these ports 38 may be plugged. Cyclone housing 36 is preferably a Nordson Model 237-615 accumulator obtainable from Nordson Corporation in Westlake, Ohio. An air vent 42 is connected to an upper portion of cyclone housing 36 above ports 30, 32, 34 and includes a compressed air inlet 44 to receive a small amount of compressed air, such as on the order of 5–15 psig. Air vent 42 leads to a filter box 46 having a filter 48 which captures the generally small amount of powder traveling through vent 42. Filter 48 may be removably affixed in place with knobs 49 to allow for cleaning or replacement.

As generally shown in FIG. 2, air and powder will be drawn into cyclone housing 36 with a cyclonic flow pattern. As is known, such as disclosed in U.S. Pat. No. 4,710,286, this flow pattern will cause the powder to lose energy and drop out of cyclone housing 36 while air will be separated from the powder and drawn upward through vent 42. This upward suction of air is assisted in the present invention by the injection of compressed air, as described above, through inlet 44. As also generally shown in FIGS. 1 and 2, apparatus 10 may be supported with suitable frame structure 50 generally associated with the accumulator and filter box portions of apparatus 10 and frame structure 50*a* generally associated with the powder coating structure 12 of apparatus 10. Apparatus 10 may further be manufactured in a more portable manner and include lockable, height adjustable casters or wheels 52.

Referring mainly to FIG. 2, cyclone housing 36 is mounted above and communicates with a powder reclaim feeder 60. While cyclone housing 36 and powder reclaim feeder 60 are described as part of accumulator 20, it will be appreciated that accumulator may take other forms when practicing various aspects of the invention. A new or virgin powder feeder 62 is mounted adjacent powder reclaim feeder 60 and includes a removable lid 64 for allowing feeder 60 to be loaded with new powder 65. Powder reclaim feeder 60 receives excess powder 67 being drawn out of powder coating structure 12. Respective aligned openings 66, 68 are disposed in powder reclaim feeder 60 and new powder feeder 62 to allow transfer of new powder 65 from new powder feeder 62 into powder reclaim feeder 60. During this transfer, new powder is mixed with reclaimed or excess powder 67. It should be noted that the term "new" as used throughout with respect to powder 65 and powder feeder 62 is not meant in any limiting fashion. For example, powder 65 could also be composed of reclaimed or recycled powder which is periodically transferred or loaded into feeder 62. The powder transfer between new powder feeder 62 and powder reclaim feeder 60 may be accomplished in several manners, however, the preferred manner is with a conveyor 70 taking the form of a motorized, rotatable auger. Auger 70 is rotated with a conventional motor 72 and gear box 74 suitably connected to rotate auger 70. Auger 70 further extends through a pipe or conduit 76 connected to an outlet portion of powder reclaim feeder 60 using fasteners 77. As shown in FIG. 2, the outlet of pipe 76 leads to the interior of powder coating structure 12 such that powder drops onto fluidized bed 14.

As will be discussed further below, and still referring to FIG. 2, powder reclaim feeder 60 and new powder feeder 62 include respective proximity sensors 78, 80 for sensing the levels of powder 67 and 65 within powder reclaim feeder 60 and new powder feeder 62. For example, proximity sensor 78 can determine when a level of powder 67 is too high such that it may interfere with the operation of cyclone housing 36. A signal from sensor 78 may then be used to prompt the operator to take action or direct the operation of motor 72 to turn auger 70. On the other hand, proximity sensor 80 may be used to determine when the level of powder 65 within new powder feeder 62 is too low and then indicate that additional powder needs to be added by the user. As further shown in FIGS. 1 and 2, a plurality of control boxes 82, 84, 86 may be provided for housing the various electrical and pneumatic controls used to operate apparatus 10 as will be discussed below with reference to FIG. 5.

Referring back to FIG. 1, in this exemplary embodiment powder coating structure 12 is an enclosure including a central area 90 in which the coating operation takes place and two powder drag out areas 92, 94. As shown with respect to drag out area 92, an internal wall 96 substantially separates central area 90 from drag out area 92. Although not shown in the drawing, the same structure exists as between central area 90 and drag out area 94. Appropriately sized openings, including openings 98, 100, 102, are contained in powder coating structure 12 for allowing the continuous travel of wire 18 or any other desired part or parts to pass into and out of coating structure 12. Coating structure 12 includes an upper lid 104 which may be hinged and locked in a substantially airtight fashion using latches 106, 108. Thus, it will be appreciated from a review of FIGS. 1 and 2 that positively pressurized air forced through fluidized bed 14 and powder bed 110, coupled with the vacuum being drawn through conduit 24 will cause a powder cloud 112 (FIG. 2) to form within central area 90. This powder cloud 112 will be electrostatically attracted to the grounded wire 18. At the same time, vacuum drawn through conduits 22 and 26 connected to respective drag out areas 92, 94 will draw smaller amounts of powder from central area 90 into the respective drag out areas 92, 94 and finally into accumulator.

Figure 3:
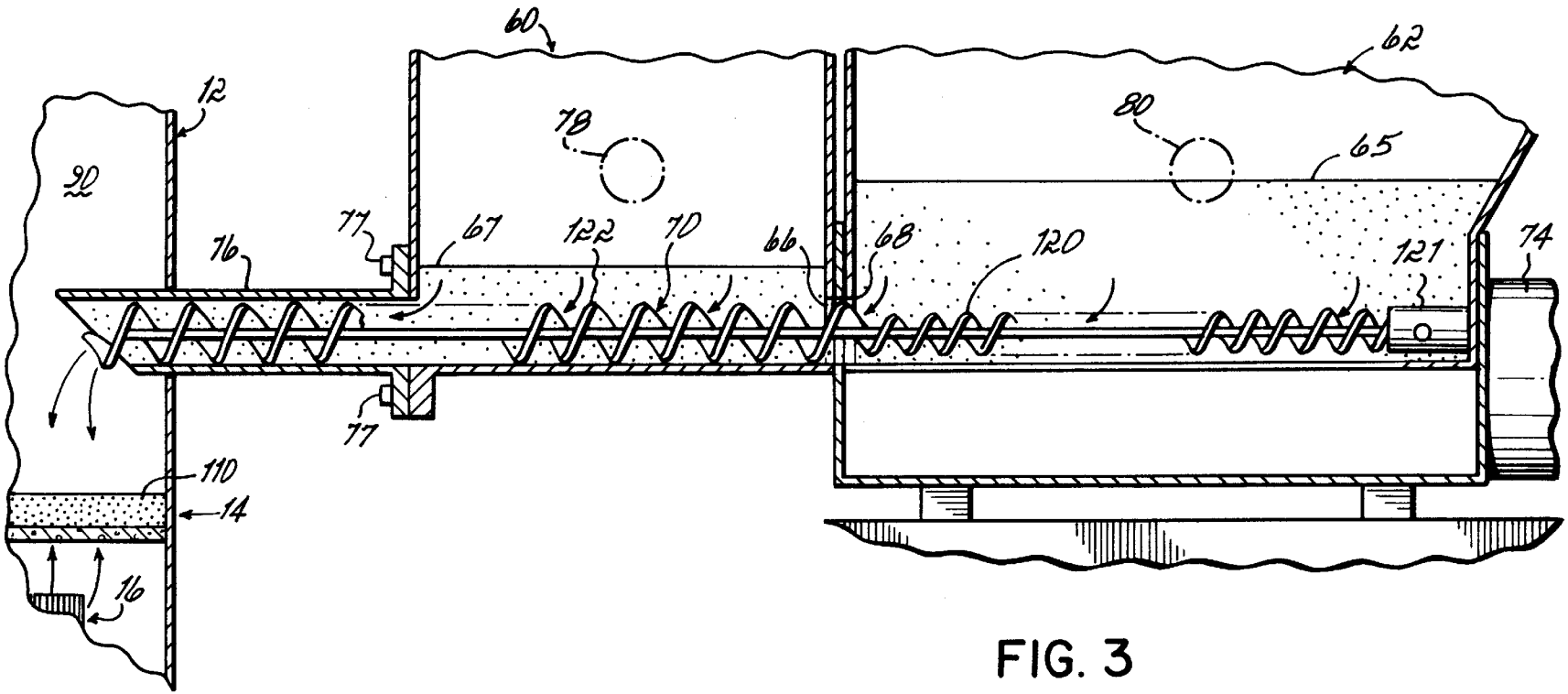
FIG. 3 is an enlarged view of the conveyor and powder feeding structure shown in FIG. 2.

Referring briefly to FIG. 3, one preferred auger conveyor 70 includes first and second sections 120, 122 respectively disposed within new powder feeder 62 and powder reclaim feeder 60. First section 120 is connected to an output of gear box 74 with a coupling 121 and may be an auger portion having a smaller pitch and/or a smaller diameter than second section 122. This will ensure that for a given revolution of auger 70, more powder is transferred out of powder reclaim feeder 60 than out of new powder feeder 62. This helps ensure that the level of excess or reclaimed powder 67 contained in powder reclaim feeder 60 does not reach a height which may interfere with the operation of cyclone housing 36. In the preferred embodiment, first section 120 has a one inch outer diameter and a $^{15}/_{16}$ inch pitch while section 122 has a $1^{7}/_{16}$ outer diameter and a $1^{1}/_{8}$ inch pitch. Also, since powder reclaim feeder 60 is disposed closer to powder coating structure 12, excess or reclaimed powder 67 will be the first powder to be transferred into powder coating structure 12. As conveyor 70 leads from new powder feeder 62 into powder reclaim feeder 60, mixing of the two powders 65, 67 will take place within powder reclaim feeder 60 prior to its transfer into powder coating structure 12.

Figure 4:
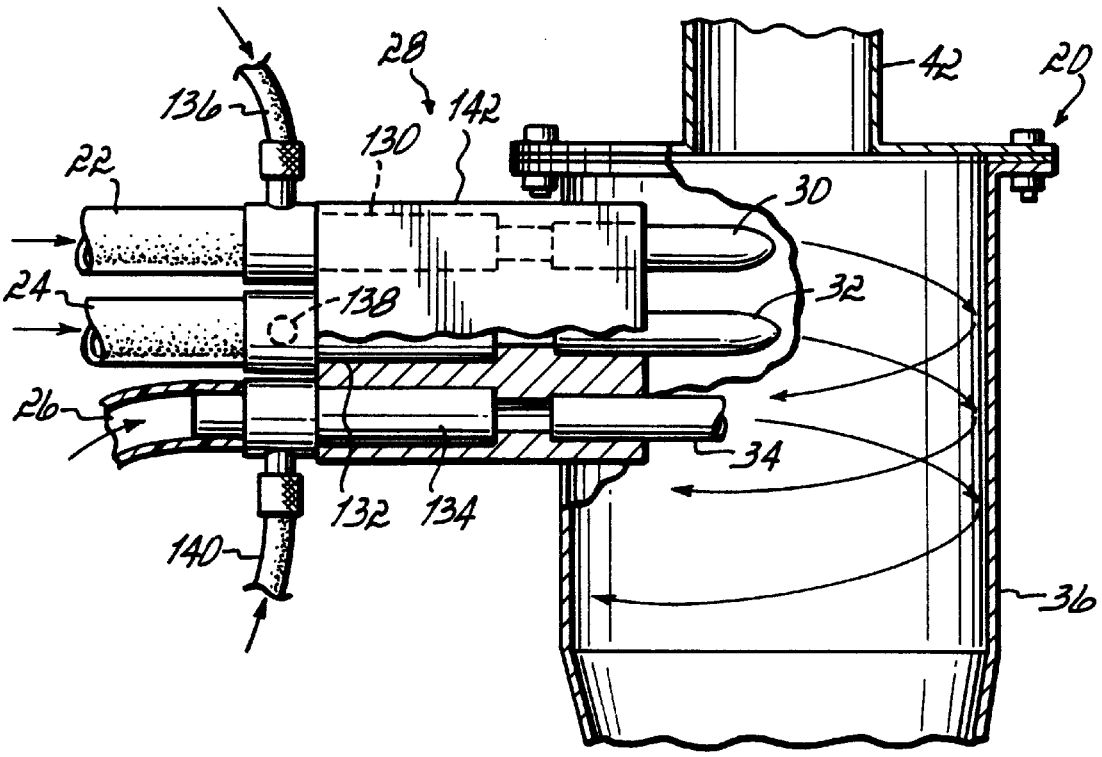
FIG. 4 is an enlarged view showing the operation of the cyclone housing of FIG. 2.

Referring now to FIG. 4, the vacuum source 28 in this exemplary embodiment advantageously comprises a plurality of vacuum pumps 130, 132, 134. Although various types of powder transfer devices may be used to advantage in applying certain principles of this invention, it is preferred that vacuum pumps, powder pumps or air amplifiers be used which may be operated through the use of compressed air inputs. Thus, FIG. 4 shows respective inlets 136, 138, 140 that direct compressed air into pumps 130, 132, 134 to draw powder and air from left to right, as shown in FIG. 4, through conduits 22, 24, 26 and into cyclone housing 36 via ports 30, 32, 34. Pumps 130, 132, 134 may be suitably mounted within a housing 142. This type of pump is also sometimes referred to as an air amplifier and may be obtained as Model DF5-6 pumps from Vaccon Company, Inc. located in Medfield, Mass.

Figure 5:
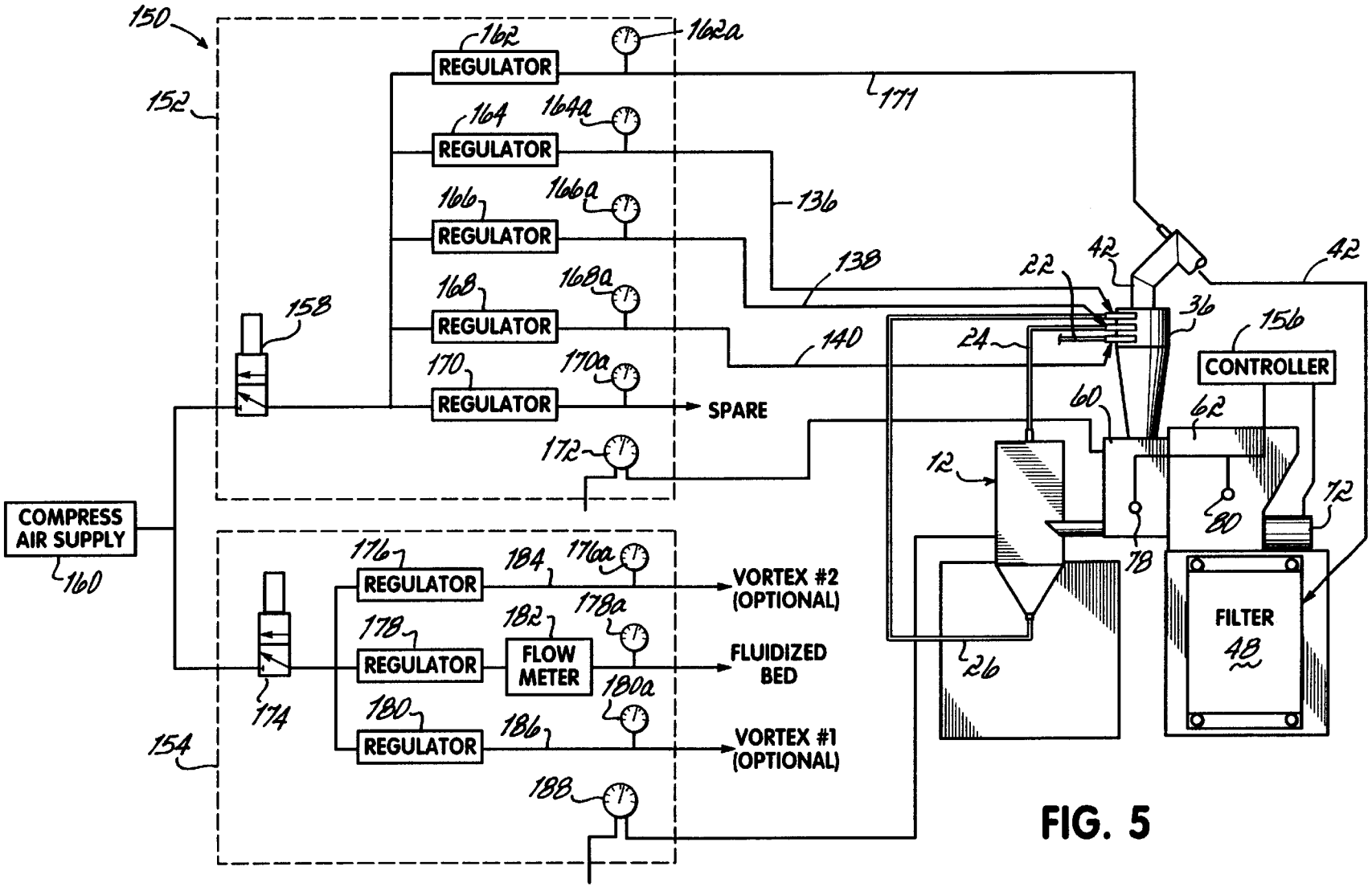
FIG. 5 is a schematic representation of the control system associated with the apparatus of FIG. 1.

A control system is schematically shown in FIG. 5 for controlling the operation of pneumatic and electrical components associated with apparatus 10. Generally speaking, control system 150 includes a portion 152 dedicated to controlling the powder collection and air venting aspects of accumulator 20. Another control portion 154 is dedicated to pneumatic control associated with powder coating structure 12. Finally, a conventional programmable controller 156 is provided and may, for example, process signals from proximity sensors 78, 80 to control the operation of motor 72 as well as perform other control functions as will be apparent to those of ordinary skill from a review of this disclosure. In this regard, for example, proximity sensor 78 may send a signal indicating a high level of powder in powder reclaim feeder 60. Controller 156 may be programmed to shut down apparatus 10 if this condition exists or may be programmed to start motor 72 to transfer additional powder from powder reclaim feeder 60 into powder coating structure 12. Proximity sensor 80 may send a signal to controller 156 if a low level of powder is indicated in new powder feeder 62. This may, for example, activate an indicator light or sound generator prompting the operator to add powder. In this case, controller 156 may also be programmed to shut down apparatus 10 until additional powder is added to new powder feeder 62. Proximity sensors 78 and 80 may each be capacitive type proximity sensors, such as Model #KIE2015BOA/LS100AK, available from Efector in Exton, Pa.

Control portion 152 includes an electrically operated two-way solenoid valve 158 connected to a source of compressed air 160 for delivering compressed air preferably at 80–100 psig and 70 cfm to a plurality of pressure regulators 162, 164, 166, 168, 170 each having respective gauges 162*a*, 164*a*, 166*a*, 168*a*, 170*a* for displaying the regulated pressure. It will be understood that other conventional control valve set ups may be used as well. Regulator and gauge 162, 162*a* are respectively connected to an air line 171 leading to air input 44. This air pressure is preferably maintained at about 5–15 psig. Regulators and associated gauges 162, 162*a*, 164, 164*a*, 166, 166*a*, are respectively connected to air input lines 136, 138, 140 associated with the operation of vacuum pump 130, 132, 134 as shown best in FIG. 4. Air pressure within input lines 136, 140 is preferably set to 10–30 psig. This pressure may be adjusted depending on the application and coating requirements. Regulator and associated pressure gauge 170, 170*a* may be provided in control system 150 as a spare.

In accordance with another aspect of the invention, a differential pressure gauge 172 may be operatively connected to the interior of powder reclaim feeder 60 (FIG. 2). Specifically, this differential pressure gauge may be a Minihelic II differential pressure gauge, Series and Model 2-5000 with a sensing range of 0–1.0 inches water column obtainable from Dwyer in Willow Grove, Pa. Pressure gauge 172 is used to indicate the pressure inside powder reclaim feeder 60. When the air pressure leading to air vent input 44 is increased, the reading on differential pressure gauge 172 will also increase thereby indicating a growing negative pressure inside powder reclaim feeder 60. It is desirable to keep the pressure inside powder reclaim feeder 60 as neutral as possible. Preferably, a reading of 0.05–0.3 inches water column is maintained on gauge 172. For the preferred apparatus 10, the above-mentioned air pressure of 5–15 psig maintained this target pressure inside powder reclaim feeder 60. Thus, when the system is operating in the proper range, new or virgin powder may be added to the new powder feeder 62 without experiencing airborne powder therein due to undesirable positive pressure in the system. This also prevents undesirable positive pressure from reaching coating structure 12 (FIG. 2), for example, through pipe 76.

Control portion 154 may also include a solenoid air valve 174 also connected to compressed air supply 160 for selectively supplying compressed or positively pressurized air to one or more pressure regulators. In the specific system shown, pressure regulators 176, 178, 180 are shown. Each of these regulators are associated with a respective pressure gauge 176*a*, 178*a*, 180*a* showing the output air pressure. Regulator 178 is further connected to a flow meter 182 in a conventional manner to regulate the flow of positively pressurized air to fluidized bed 14. Regulators 176, 180 connected to gauges 176*a*, 180*a* and air lines 184, 186 are specifically dedicated to a vortex option as generally discussed in the above incorporated U.S. Pat. No. 4,606,928 for the specific application of coating wires and the like. A photohelic level sensor 188 is connected to coating structure 12 and, specifically, to coating area 90. As is known in the art, this sensor can operate in conjunction with controller 156 to cause powder to be conveyed into coating structure 12 as needed. In the present case, controller 156 would activate motor 72 to turn auger 70 (FIG. 2) as previously described.

The structure and operation of the preferred embodiments of this invention should be understood in accordance with the foregoing description. While the present invention has been illustrated by a description of various embodiments and while these embodiments have been described in considerable detail, it is not the intention of the Applicants to restrict or in any way limit the scope of the appended claims to such detail. As a general example, the various features of the apparatus described herein in detail may be combined or substituted in various manners. Additional advantages and modifications will readily appear to those skilled in the art. The invention in its broader aspects is therefore not limited to the specific details, representative apparatus and methods as shown and described.

What is claimed is:

1. Electrostatic fluidized bed powder coating apparatus comprising:

powder coating structure defining a powder coating area in which a work piece is to be coated during a powder coating operation, a powder fluidizing bed operatively disposed relative to the powder coating structure and adapted to receive and fluidize a supply of powder during the powder coating operation, an electrostatic charging device operatively disposed relative to the powder fluidizing bed to charge the powder, a powder accumulator for collecting excess powder from the powder coating structure during the powder coating operation, and a vacuum pump communicating between the powder coating structure and the powder accumulator and operable by a source of compressed air for forming and controlling a cloud of powder emanating from the fluidizing bed and for transferring excess powder from the powder coating structure to the powder accumulator.

2. The powder coating apparatus of claim 1 further comprising a regulator operatively connected to the vacuum pump for varying the amount of compressed air being used to operate the vacuum pump.

3. The powder coating apparatus of claim 1 further comprising a plurality of the vacuum pumps connected with a plurality of conduits leading from different locations of the powder coating structure to the powder accumulator.

4. The powder coating apparatus of claim 1, wherein the powder coating area is a central area within the powder coating structure and the powder coating structure further includes a pair of drag out areas substantially separated from the central area but communicating therewith, wherein at least one additional source of vacuum transfers powder from the drag out areas to the powder accumulator.

5. The powder coating apparatus of claim 1, wherein the accumulator is a cyclone housing including an air and powder inlet through which air and excess powder are received from the vacuum pump with a cyclonic flow pattern.

6. The powder coating apparatus of claim 5, wherein a powder reclaim chamber is located below the air and powder inlet of the cyclone housing, and an air vent is disposed above the air and powder inlet, whereby air entering through the inlet exits the cyclone housing through the air vent while excess powder drops into the powder reclaim chamber.

7. The powder coating apparatus of claim 6 further comprising a pressure gauge operatively connected to the powder reclaim chamber for measuring a level of pressure therein.

8. The powder coating apparatus of claim 6 further comprising a sensor for detecting a level of powder in the powder reclaim chamber.

9. The powder coating apparatus of claim 6, wherein a powder conveyor is connected between the powder reclaim chamber and the powder coating to form a feeder area for transferring the excess powder back into the powder coating area.

10. The powder coating apparatus of claim 9, wherein the powder conveyor is a motorized, rotatable auger extending from the powder reclaim chamber into the powder coating area.

11. The powder coating apparatus of claim 9 further comprising a new powder feeder in communication with the powder coating area, said new powder feeder being adapted to receive a supply of new powder for use in the powder coating area.

12. The powder coating apparatus of claim 11, wherein the new powder feeder and the powder reclaim chamber each communicate with the powder coating area via the powder conveyor.

13. The powder coating apparatus of claim 12, wherein the powder conveyor is a motorized, rotatable auger.

14. The powder coating apparatus of claim 13, wherein the auger includes a first section disposed in the new powder feeder and a second section disposed in the powder reclaim chamber, and the second section conveys powder at a higher rate than the first section.

15. Electrostatic fluidized bed powder coating apparatus comprising:

powder coating structure defining a powder coating area in which a work piece is to be coated during a powder coating operation, a powder fluidizing bed operatively disposed relative to the powder coating structure and adapted to receive and fluidize a supply of powder during the powder coating operation, an electrostatic charging device operatively disposed relative to the powder fluidizing bed to charge the powder, a cyclone housing for collecting excess powder from the powder coating structure during the powder coating operation, and a plurality of vacuum pumps connected to different locations of the powder coating structure and communicating between the powder coating structure and the cyclone housing, the pumps being operable by a source of compressed air for forming and controlling a cloud of powder emanating from the fluidizing bed and for transferring excess powder from the powder coating structure into the cyclone housing with a cyclonic flow pattern.

16. Electrostatic fluidized bed powder coating apparatus comprising:

powder coating structure defining a powder coating area in which a work piece is to be coated during a powder coating operation, a powder fluidizing bed operatively disposed relative to the powder coating structure and adapted to receive and fluidize a supply of powder during the powder coating operation, an electrostatic charging unit operatively disposed relative to the powder fluidizing bed to charge the powder, a vacuum pump having a powder inlet and a powder outlet, the powder inlet communicating with the powder coating area, a cyclone housing operatively connected with the outlet of the vacuum pump for receiving excess powder in a cyclonic flow pattern, a powder reclaim feeder communicating with and disposed below the cyclone housing for receiving the excess powder from the cyclone housing, a new powder feeder communicating with the powder reclaim feeder, and powder conveying structure operatively connected between the powder reclaim feeder and the powder coating area and between the new powder feeder and the powder reclaim feeder, wherein the powder conveying structure is capable of transferring powder from the powder reclaim feeder to the powder coating area at a higher rate than from the new powder feeder to the powder reclaim feeder.

17. The powder coating apparatus of claim 16 further comprising a regulator operatively connected to the vacuum pump for varying the amount of pressurized air being used to operate the pump and thereby varying the amount of excess powder being drawn from the powder coating structure by the vacuum pump.

18. The powder coating apparatus of claim 16, wherein the powder conveying structure further comprises a rotatable, motorized auger extending through both the new powder feeder and the powder reclaim feeder and further extending into the powder coating structure.

19. The powder coating apparatus of claim 18, wherein the auger includes a first section disposed in the new powder feeder and a second section disposed in the powder reclaim feeder, the second section rotating with the first section but having a higher powder transfer rate than the first section.

20. The powder coating apparatus of claim 16, wherein the cyclone housing includes an air vent at an upper portion thereof, whereby air from the vacuum pump can exit the cyclone housing through the air vent as powder is received by the powder reclaim feeder.

21. The powder coating apparatus of claim 20, wherein the air vent communicates with a filter for separating powder from the air exiting the cyclone housing.

22. The powder coating apparatus of claim 16 further including a sensor operatively connected to the powder reclaim feeder for producing a signal representing a level of powder in the powder reclaim feeder.

23. The powder coating apparatus of claim 16 further including a pressure gauge operatively connected to the powder reclaim feeder for indicating pressure within the powder reclaim feeder.

24. Electrostatic fluidized bed powder coating apparatus comprising:

powder coating structure having walls generally defining a powder coating area in which a work piece is to be coated during a powder coating operation, a powder fluidizing bed operatively disposed relative to the powder coating structure and adapted to receive and fluidize a supply of powder during the powder coating operation, an electrostatic charging unit operatively disposed relative to the powder fluidizing bed to charge the powder, a powder transfer device for drawing excess airborne powder out of the powder coating area, a powder reclaim feeder in communication with the powder transfer device for receiving the excess powder transferred from the powder coating area, a new powder feeder for supplying powder to the powder coating area, and a powder conveyor extending within the new powder feeder, the powder reclaim feeder and the powder coating structure, wherein the powder conveyor is capable of transferring powder out of the powder reclaim feeder at a higher rate than out of the new powder feeder.

25. Powder coating apparatus comprising:

a new powder feeder and a powder reclaim feeder mounted adjacent one another, powder coating structure mounted adjacent the powder reclaim feeder, a cyclone housing disposed above and in communication with the powder reclaim feeder, at least one powder transfer device connected generally between the cyclone housing and the powder coating structure for transferring airborne powder from the powder coating structure to the powder reclaim feeder, and a conveyor operative within the new powder feeder and the powder reclaim feeder to transfer powder into the powder coating structure.

26. The powder coating apparatus of claim 25, wherein the powder reclaim feeder is disposed between the new powder feeder and the powder coating structure such that the conveyor transfers powder from the new powder feeder into the powder reclaim feeder and further transfers powder from the powder reclaim feeder into the powder coating structure.

27. The powder coating apparatus of claim 26, wherein the conveyor includes an auger.

28. The powder coating apparatus of claim 27, wherein the auger includes a first section disposed in the powder reclaim feeder and a second section disposed in the new powder feeder, and the first section conveys powder at a higher rate than the second section.

* * * * *